US007252555B2

(12) United States Patent
Moessinger

(10) Patent No.: US 7,252,555 B2
(45) Date of Patent: Aug. 7, 2007

(54) PIN CONNECTOR

(75) Inventor: Marc Moessinger, Sindelfingen (DE)

(73) Assignee: Verigy (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 11/302,788

(22) Filed: Dec. 14, 2005

(65) Prior Publication Data

US 2006/0134977 A1 Jun. 22, 2006

(30) Foreign Application Priority Data

Dec. 17, 2004 (EP) ..... 04106700

(51) Int. Cl.
*H01R 13/24* (2006.01)

(52) U.S. Cl. ..... 439/700; 439/579

(58) Field of Classification Search ..... 439/579, 439/700

See application file for complete search history.

(56) References Cited

U.S. PATENT DOCUMENTS 3,848,164 A 11/1974 Otte
5,906,511 A 5/1999 Bozzer et al.
5,997,348 A * 12/1999 Shepherd ..... 439/579
6,377,062 B1 * 4/2002 Ramos et al. ..... 324/758
6,547,593 B1 4/2003 Beckous
2001/0046802 A1 11/2001 Perry et al.
2001/0050177 A1 12/2001 Sekizuka
2002/0011863 A1 1/2002 Takahashi et al.

OTHER PUBLICATIONS

EP Search Report dated Mar. 5, 2005.

* cited by examiner

*Primary Examiner*—Truc Nguyen
(74) *Attorney, Agent, or Firm*—Perman & Green, LLP

(57) ABSTRACT

A connector for connecting electric cables, in particular in automatic test equipment, includes a housing provided with a cable contact side having a plurality of cable receptions each adapted for electrically connecting to an electrical cable, a pin contact side having a plurality of pin contact zones each adapted for electrically contacting to a spring loaded contact pin, and a plurality of jackets surrounding each a signal conductor electrically insulated from the jacket, where each signal conductor electrically connects one of the pin contact zones to one of the electrical cables.

11 Claims, 3 Drawing Sheets

Fig. 3
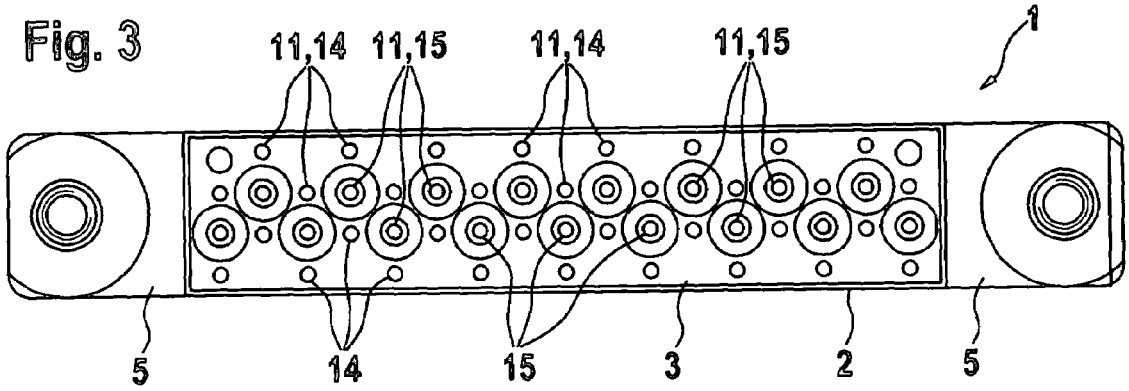
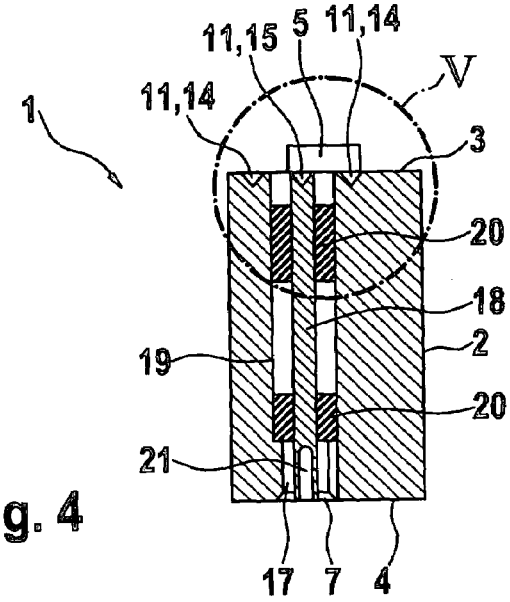
Fig. 4
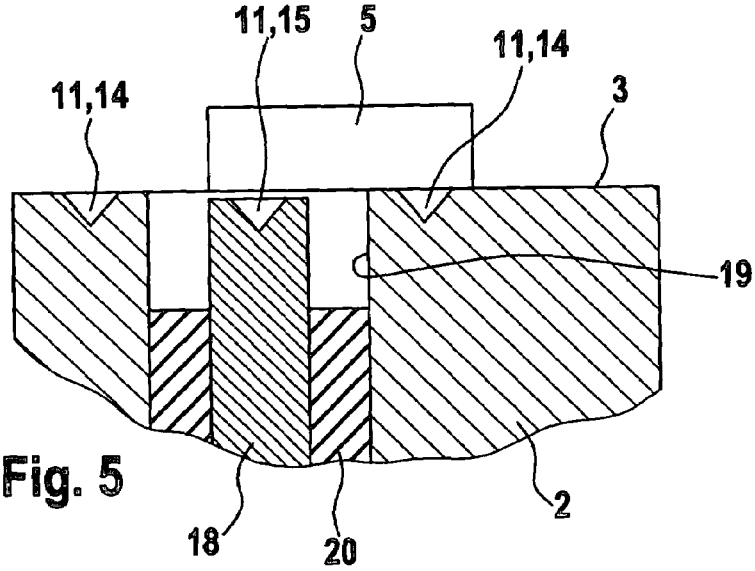
Fig. 5

PIN CONNECTOR

CROSS-REFERENCE TO RELATED APPLICATIONS

This application claims priority from European Patent Application No. 04106700.0, filed on Dec. 17, 2004.

BACKGROUND

The present invention relates to a connector for connecting electric cables to electrical pins, in particular to spring loaded electrical pins.

Modern automatic test equipment, e.g. a tester, is used for testing integrated circuits like microprocessors or chips and memory chips. These integrated circuits to be tested are also called device under test. A signal path between the device under test and the test equipment usually comprises coax cables. Connectors of the present species are used to electrically connect coax cables. Since the tact rate or operation speed of such integrated circuits increases, the signals to be transmitted between the respective device under test and the test equipment increases, too. At high frequencies of transmitted signals the quality of the signal transmittance is of demanded relevance. High quality of signal transmission helps to improve the performance of the test equipment.

SUMMARY OF THE DISCLOSED EMBODIMENTS

It is an object of the present invention to provide an improved performance in signal transmittance between the device under test and the respective test equipment. The object is solved by the independent claims. Further embodiments are shown by the dependent claims.

By providing a connector comprising a pin contact side and a cable contact side according to claim 1 of the present invention the performance of signal transmission between contact pins on the one hand and cables on the other hand is improved.

A further feature of the connector according to a further embodiment is the use of the housing as electrical ground for the signals to be transmitted. This grounded housing provides a shielding for the signals to be transmitted and reduces disturbances and noise.

The performance can be further improved by integrating center receptions adapted for receiving an inner conductor of the respective cable and/or the pin contact zones into signal conductors providing the signal transmission within the connector. High integration leads to less single constructional elements and therefore reduces manufacturing costs.

Another improvement of the performance may be achieved by integrating a grounded jacket of cable receptions of the connector and/or ground contact zones of the connector into the housing. This measure also helps to find an inexpensive solution, which is also easy to manufacture.

Basically cable receptions of the connector may be adapted for providing a permanent or non-detachable connection with the respectively adapted cables. This measure may be a low cost solution. Alternatively, the cable receptions may be adapted for providing a push and pull or detachable connection for the respectively adapted cables. These measures provide a multi-use connection, thus the connector can be used and reused in different implementations.

By providing a tester comprising a test board, an outer interface and an inner interface, the performance of signal transmission between the device under test and the test equipment is significantly improved. Said test board is adapted for receiving a device under test and is provided with several board contact zones directly electrically contacted to device contact zones which are directly electrically contacted to device pins of the device under test when said device is mounted on the test board. The test board is mounted on said outer interface, which is provided with several outer pins directly electrically contacted to the device contact zones. Said inner interface is provided with several inner pins electrically connected to test equipment of the tester. The outer pins are directly connected to coax cables, wherein several coax cables are connected to a connector and said connector is provided with pin contact zones. Furthermore, each connector is mounted on the inner interface such that the pin contact zones are directly contacted to the inner pins.

It is very important for the tester according to the invention that the signal path between the device under test and the test equipment is of highest quality to provide a signal path with high performance at high signal frequencies. To this aim the signal path provided within the tester according to the invention for example does not comprise conductors integrated in boards, e.g. as printed circuits. Every single signal path is separately shielded by using a signal-transmitting conductor of very low resistance surrounded by a grounded conductor. Between the outer pins and the connector this shielded signal path is realized by the coax cables. Within the connector this shielded signal path is realized by the signal conductor, which is arranged within a housing of the connector and is electrically insulated against this housing, said housing providing the grounded shield.

Another important feature for improving the performance is the point that the board contact zones of the test board are directly electrically connected to device contact zones, which—when the device under test is mounted on the test board—are directly electrically contacted to device pins of the device under test. According to this, the board contact zones are arranged very close to the device pins. This measure reduces noise and disturbances.

According to a further embodiment the test board may be provided with contact members which penetrate the test board, which provide on the one side of the test board the board contact zones and which provide on the other side of the test board the device contact zones. Therefore, the board contact zones and the device contact zones are integrated constructive parts having very low resistance.

BRIEF DESCRIPTION OF THE DRAWINGS

Other objects and many of the attendant advantages of the present invention will be readily appreciated and become better understood by reference to the following detailed description when considered in connection with the accompanying drawings. Features that are substantially or functionally equal or similar will be referred to with the same reference sign(s).

FIG. 3 depicts a top view of the connector according to arrow III in FIG. 1.

FIG. 4 depicts a cross section of the connector according to section lines IV in FIG. 1.

FIG. 5 depicts an enlarged detail V of the cross section of FIG. 4.

DETAILED DESCRIPTION OF THE DISCLOSED EMBODIMENTS

Figure 1:
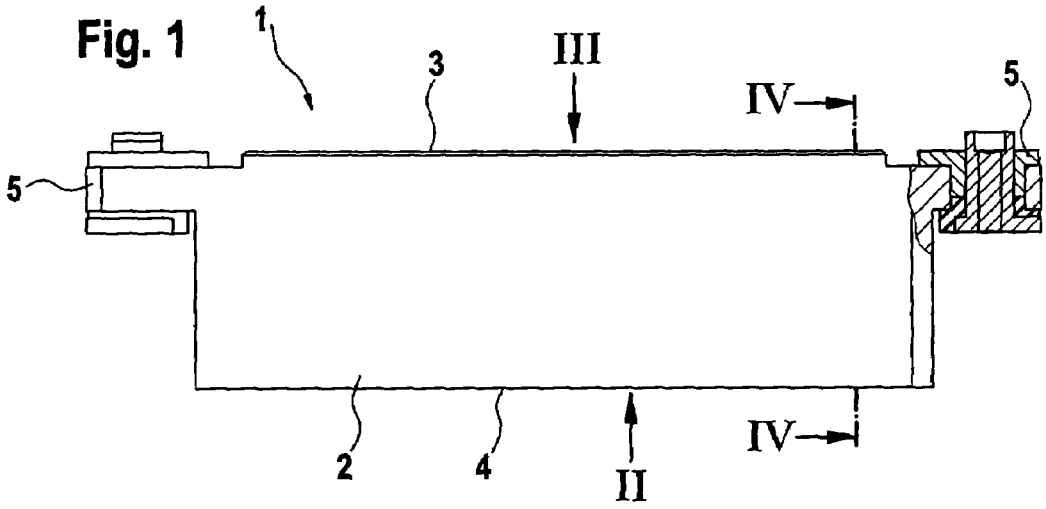
FIG. 1 depicts a side view of a connector according to the invention.

According to FIG. 1 a connector 1 according to the invention comprises a housing 2. The housing 2 is preferably adapted to be electro conductive. Therefore, the housing 2 preferably is made of metal and in particular is provided by a massive metal block. In another embodiment the housing 2 may be adapted to be insulating; preferably the housing 2 then is made of plastics or synthetics. The housing 2 is provided with a pin contact side 3 and a cable contact side 4 which sides 3 and 4 are arranged at opposite ends of the connector 1 or its housing 2, respectively. Additionally, the housing 2 may be provided with flanges 5 adapted for attaching the housing 2 to a constructive element, e.g. to a complementary connector 6 (see FIG. 6).

Figure 2:
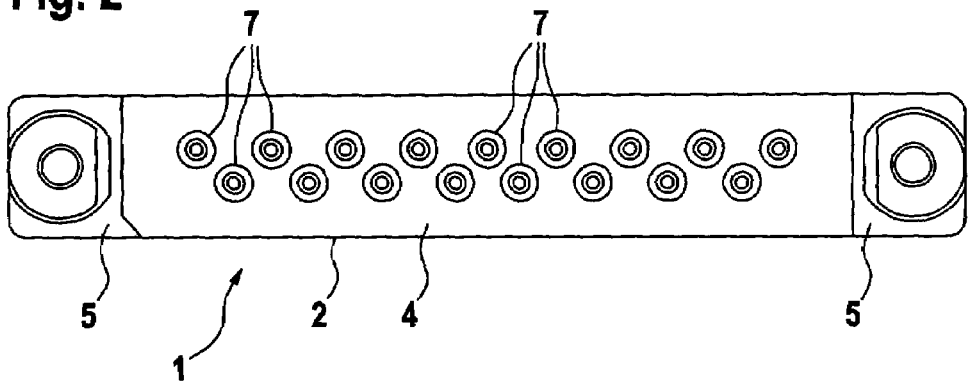
FIG. 2 depicts a bottom view of the connector according to arrow II in FIG. 1.

According to FIG. 2 the cable contact side 4 of the housing 2 comprises several coax cable receptions 7. Each coax cable reception 7 is adapted for electrically connecting a coax cable 8 (see FIG. 6). The coax cables 8 are connected to a first electronic device 9 (see FIG. 6). In the depicted embodiment the coax cable receptions 7 are adapted for providing a push-pull-connection between the housing 2 and the respective coax cables 8. Accordingly, the assembled coax cables 8 are detachably attached to the housing 2. To this aim the coax cables 8 are respectively adapted and are provided with end portions adapted to be plugged into the coax cable receptions 7 and plugged out of the coax cable receptions 7. By means of this plug-in and plug-out connection the connector 1 can be used very flexible, e.g. it is possible to retrofit a tester 10 (see FIG. 6) with the connectors 1 according to the invention.

Alternatively, it is basically possible to adapt the coax cable receptions 7 for providing a permanent connection between the coax cables 8 and the coax cable receptions 7. In such an embodiment the coax cables 8 are non-detachably attached to the housing 2. This embodiment may have reduced manufacturing costs.

The coax cables 8 are only depicted as examples not limiting the scope of the invention. Therefore, the cables 8 may be of every known cable type.

According to FIG. 3 the pin contact side 3 of the housing 2 comprises several pin contact zones 11. Each of these contact zones 11 is adapted for electrically contacting a contact pin 12 or 16, respectively (see FIG. 6). These contact pins 12, 16 are divided into ground contact pins 16 and signal contact pins 12. The signal contact pins 12 are connected to a second electronic device 13 (see FIG. 6). Accordingly, the pin contact zones 11 are divided into ground contact zones 14 and signal contact zones 15.

On the one hand the ground contact zones 14 are adapted for providing a ground contact with the respective ground contact pins 16. The ground contact pins 16 transmit ground potential. Additionally, the ground contact zones 14 are electrically connected to the housing 2. Accordingly, the housing 2 is electrically grounded, too. In the further embodiment depicted in the figures the ground contact zones 14 are integrated into the housing 2 and therefore form integrally portions of the housing 2.

On the other hand the signal contact zones 15 are adapted for providing a signal transmitting contact with the respective signal contact pins 12. The signal contact pins 12 transmit signals on another, in particular higher, potential than the ground potential. Accordingly, the signal contact zones 15 are electrically insulated from the ground contact zones 14 and from the housing 2.

In order to improve the shielding of the signal transmission the pin contact zones 11 are arranged in such a way that each signal contact zone 15 is encircled by several ground contact zones 14. In the embodiment depicted in FIG. 3, each signal contact zone 15 is surrounded by at least three ground contact zones 14. The two signal contact zones 15 adjacent to the flanges 5 are encircled only by three ground contact zones, while all other signal contact zones 15 are surrounded by four ground contact zones 14.

According to the FIGS. 4 and 5 each coax cable reception 7 comprises a jacked 17 and a signal conductor 18. The jacket 17 is electrically connected to the housing 2 and is therefore grounded. In the depicted further embodiment the jacket 17 forms an integrally portion of the housing 2. In order to provide the jackets 17 the housing 2 is provided with through holes 19 penetrating the housing 2 from the pin contact side 3 to the cable contact side 4. The inside wall of each through holes 19 form the respective jacket 17.

The signal conductors 18 are arranged centrically with respect to the respective jackets 17. Additionally, the signal conductors 18 are electrically insulated from the respective jackets 17 and from the housing 2. Furthermore, each of the signal conductors 18 is electrically connected to one of the signal contact zones 15. According to the present embodiment, each signal contact zone 15 is formed as an integral end portion of the respective signal conductor 18.

The signal conductors 18 are inserted into the through holes 19, one signal conductor 18 in every through hole 19. In order to fix the signal conductors 18 within their respective through holes 19 there are provided electrical insulators 20 operating as fastening means. The insulators 20 are ring shaped, enclose the respective signal conductor 18 and support it within the respective through hole 19.

As mentioned above, the coax cable receptions 7 are preferably adapted to provide push-pull-connections for the respective coax cables 8. To this end each of the signal conductors 18 is provided with a center reception 21. Each of these center receptions 21 is adapted for receiving an inner conductor (not shown) of the respective coax cable 8. An outer conductor (also not shown) of each coax cable 8 is then provided with a spring like jacket (not shown, too) co-operating with the jacket 17 of the coax cable reception 7, if the respective end portion of the coax cable 8 is inserted into the respective coax cable reception 7.

Figure 6:
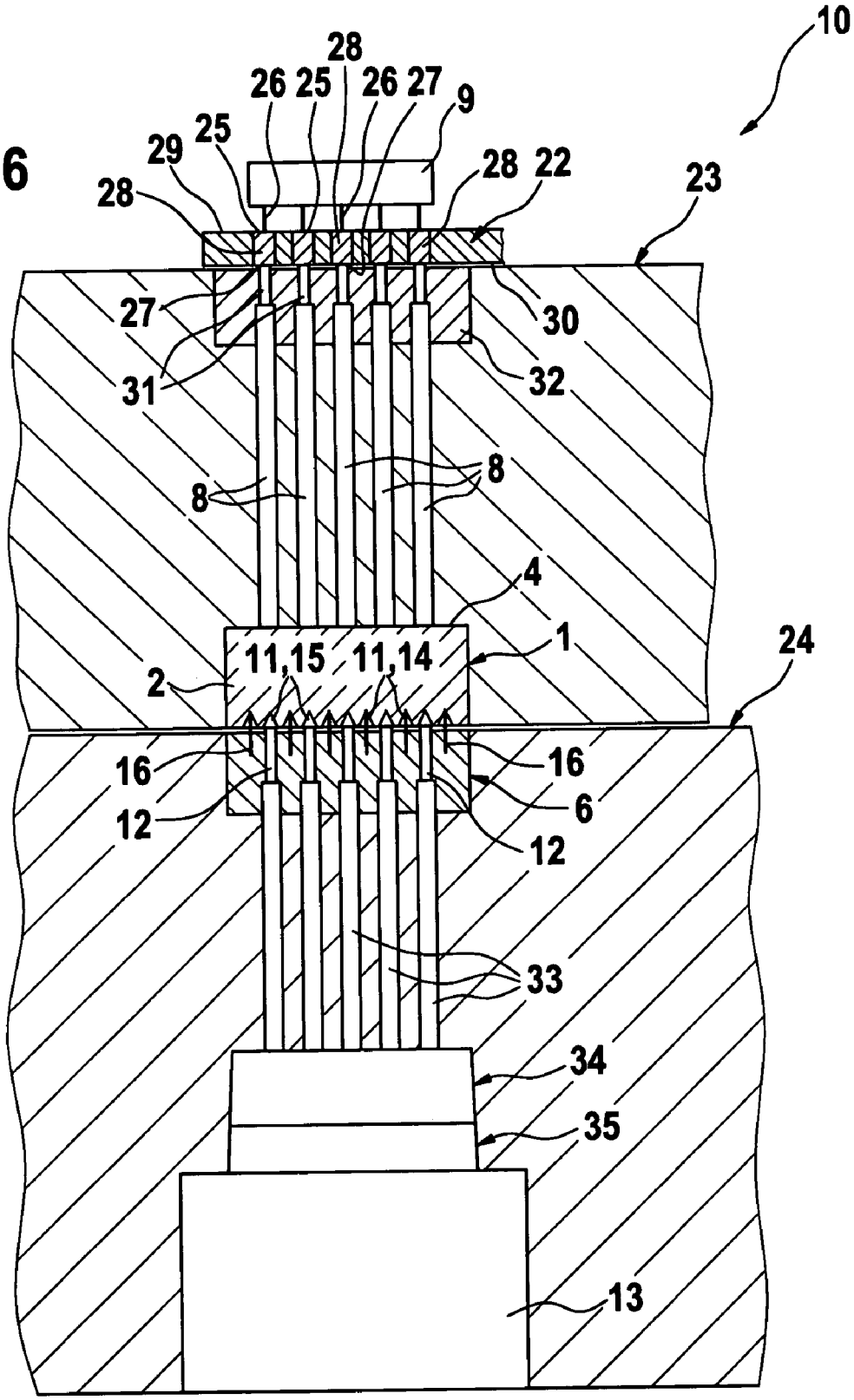
FIG. 6 depicts a very simple and diagrammed cross section of a tester according to the invention.

According to FIG. 6 the tester 10 according to the invention comprises a test board 22, an outer interface 23 and an inner interface 24. The tester 10 is adapted for testing an integrated circuit, which is called "device under test" in the following and to which reference is made with 9. This device under test 9 is provided with several device pins 26.

The test board 22 is adapted for receiving the device under test 9. Therefore, the test board 22 is provided with several device contact zones 25. In a mounted position of the device under test 9 the device contact zones 25 are electrically contacted to the device pins 26. Fastening means for securing the device under test 9 to the test board 22 like for example a socket are not shown. Such a socket or contactor is mounted on the test board 22 and is provided with receptions adapted to receive the device pins 26 and electrically contacted to the device contact zones 25.

The test board 22 is also provided with several board contact zones 27 directly electrically connected to the device contact zones 25. In the further embodiment depicted in FIG. 6 the test board 22 is provided with several contact members 28. These contact members 28 penetrate the test board 22 from a side 29 facing the device under test 9 to a side 30 turned away from the device under test 9. The contact members 28 provide on the side 29 facing the device under test 9 the device contact zones 25 and on the side 30 turned away from the device under test 9 the board contact zones 27. Accordingly, the connection between the device contact zones 25 and the board contact zones 27 has a very low resistance.

Within another embodiment (not shown) the device contact zones 25 and the board contact zones 27 are electrically connected by means of conductors provided within the test board 22. These conductors allow different allocations for the board contact zones 27 in order to achieve more space for mounting and for contacting the board contact zones 27.

The test board 22 is mounted onto the outer interface 23. The outer interface 23 is provided with several outer pins 31. These outer pins 31 may be provided on a pin carrier 32. The outer pins 31 on the one hand are directly electrically connected to the board contact zones 27 and on the other hand are directly connected to the coax cables 8. Several of these coax cables 8 are provided with the connector 1 according to the invention.

The inner interface 24 is provided with the contact pins 12 and 16. These contact pins 12, 16 may also be called inner pins 12, 16 and may be provided on the other connector 6, which is formed complementarily to the connector 1. These inner pins 12, 16 are electrically connected to the test equipment 13 of the tester 10. Accordingly, in the tester 10 the connector 1 according to the invention is used to provide an electrical connection between the coax cables 8 and the test equipment 13. It should be clear that more than one of such connectors 1 may be used within the tester 10 to connect a multitude of coax cables 8 with different components of the test equipment 13. If the connector 1 is mounted on the inner interface 24 its pin contact zones 11 or 14 and 15, respectively, are directly contacted with the inner pins 12, 16.

According to the present embodiment some of the inner pins 12,16, namely the signal contact pins 12 are electrically connected to other coax cables 33. The other coax cables 33 are electrically connected to the test equipment 13, wherein the last-mentioned connection may be provided by means of another connector 34 co-operating with another interface 35 directly mounted on the test equipment 13.

The inner pins 12, 16 or the contact pins 12, 16, respectively, are preferably adjustable and spring loaded in the contacting direction. Such pins 12, 16 usually are called "pogo pins". The other connector 6 is therefore a pogo pin connector 6. The connector 1 according to the invention is therefore adapted to provide a cheap, robust and high performing coax connection with a pogo pin connector 6.

It should be clear, that the outer pins 31 also could be designed as pogo pins.

A main object of the tester 10 according to the invention is to provide a high performance with respect to signal transmittance between the device under test 9 and the test equipment 13. To this aim the tester 10 is adapted to provide signal paths between the device under test 9 and the test equipment 13 each fully and singly shielded by ground potential.

Another important object of the invention is providing a high variability for the tester 10. The tester 10 can easily be used like a conventional tester 10 provided with a specific test board directly connected to the inner interface 24. To adapt the tester 10 to this specific test board the connectors 6 of the inner interface 24 have a particular arrangement.

The use of the connectors 1 according to the invention within the outer interface 23 allows to retrofit the tester 10 in order to connect the test board 22 without changing the arrangement of the connectors 6 of the inner interface 24. This is possible, since the connectors 1 according to the invention are connected via the coax cables 8 to the board contact zones 27 and are adapted for being connected to the connectors 6 of the inner interface 24.

With help of the connectors 1 according to the invention the outer interface 23 provides an adapter provided for a high performing signal transport from the board contact zones 27 to the inner pins 12 of the connectors 6 of the inner interface 24. Therefore, the tester 10 can be easily retrofitted by exchanging a conventional test board with the adapter interface or outer interface 23, respectively. Additionally, such an adapter interface shows long durability.

What is claimed is:

1. A connector for connecting coax electric cables, in an automatic test equipment, the connector comprising:

a housing;

a cable contact side comprising a plurality of coax cable receptions each adapted for electrically connecting to an electrical coax cable;

a pin contact side comprising a plurality of pin contact zones each adapted for electrically contacting to a respective spring loaded contact pin, wherein a first number of the pin contact zones are signal contact zones adapted for providing a signal transmitting contact and a second number of the pin contact zones are ground contact zones adapted to provide an electrical grounding;

a plurality of jackets each surrounding a signal conductor, wherein each signal conductor is electrically insulated from the jacket;

wherein each signal conductor electrically connects one of the pin contact zones to one of the electrical coax cables; and wherein the pin contact zones and the cable receptions are integral portions of the respective signal conductors.

2. The connector according to claim 1, wherein the pin contact zones are each integrally portions of the respective signal conductors.

3. The connector according to claim 1, wherein the housing is made out of an electro conductive material adapted to be electrically grounded, and wherein the ground contact zones are each integral part of to the housing.

4. The connector according to claim 1, wherein the jackets are integral part of the housing.

5. The connector according to claim 1, wherein the cables are coax cables with each a shielding and a center conductor, and wherein the center conductors are each connected to one of the signal conductors.

6. The connector according to claim 1, wherein each signal conductor is inserted into a through hole penetrating the housing from the pin contact side to the cable contact side, and wherein each signal conductor is fixed within the respective through hole by means of at least one electrical insulator.

7. The connector according to claim 1, wherein the cable receptions are adapted for providing a push and pull connection for the respectively adapted cables.

8. The connector according to claim 1, wherein the cable receptions are adapted for providing a permanent connection with the respectively adapted cables.

9. The connector according to claim 7, wherein the signal conductor is provided with a center reception adapted for receiving an center conductor of a respective coax cable.

10. The connector according to claim 1, wherein the pin contact zones are arranged such that each signal contact zone is encircled by several ground contact zones.

11. The connector according to claim 1, wherein the housing is made out of an electric insulating material, in particular plastics or synthetics.

* * * * *